US009918175B2

(12) United States Patent
Lee et al.

(10) Patent No.: US 9,918,175 B2
(45) Date of Patent: Mar. 13, 2018

(54) METHOD, EQUIPMENT AND APPARATUS FOR ACQUIRING SPATIAL AUDIO DIRECTION VECTOR

(71) Applicant: Marvel Digital Limited, Hong Kong (HK)

(72) Inventors: Ying Chiu Herbert Lee, Hong Kong (HK); Ho Sang Lam, Hong Kong (HK); Tin Wai Grace Li, Hong Kong (HK)

(73) Assignee: Marvel Digital Limited, Hong Kong (HK)

( * ) Notice: Subject to any disclaimer, the term of this patent is extended or adjusted under 35 U.S.C. 154(b) by 0 days.

(21) Appl. No.: 15/216,726

(22) Filed: Jul. 22, 2016

(65) Prior Publication Data

US 2017/0289726 A1 Oct. 5, 2017

(30) Foreign Application Priority Data

Mar. 29, 2016 (HK) ..... 16103566.0

(51) Int. Cl.
*H04R 5/02* (2006.01)
*H04S 7/00* (2006.01)
*H04S 3/00* (2006.01)

(52) U.S. Cl.
CPC ..... *H04S 7/301* (2013.01); *H04S 3/008* (2013.01); *H04S 7/307* (2013.01); *H04S 2400/11* (2013.01)

(58) Field of Classification Search
CPC ..... H04R 5/02
See application file for complete search history.

(56) References Cited

U.S. PATENT DOCUMENTS

2015/0098571 A1* 4/2015 Jarvinen ..... H04S 7/302 381/1
2016/0035386 A1* 2/2016 Morrell ..... G10L 19/008 700/94
2016/0044433 A1* 2/2016 Tsingos ..... H04S 3/002 381/307
2017/0086008 A1* 3/2017 Robinson ..... H04S 7/308
2017/0245053 A1* 8/2017 Virolainen ..... H04R 3/005

(Continued)

*Primary Examiner* — Olisa Anwah

(57) ABSTRACT

Method, equipment and apparatus for acquiring a spatial audio direction vector, the method including: determining a position of a sound source in a multi-sound system; setting a parameter comprising: a human response time Δt and a tolerance percentage δ; acquiring a sound signal from the sound source; and processing the sound signal by using the parameter and acquiring a corresponding spatial audio direction vector $\vec{E}$ within each time interval Δt. A proportional constant D is determined according to a modulus of a spatial audio direction vector $\vec{E}$, and provides spatial information of depth for a virtual image corresponding to a multi-tone audio signal. A vector angle $\theta_E$ the spatial audio direction vector $\vec{E}$ provides spatial information of direction for the virtual image corresponding to the multi-tone audio signal, to improve viewer's viewing experience. This invention figures out how to enrich audience experience by applying the spatial audio directional vector to glasses-free 3D display.

15 Claims, 10 Drawing Sheets

(56) References Cited

U.S. PATENT DOCUMENTS

| | | | | |
|---|---|---|---|---|
| 2017/0272863 | A1* | 9/2017 | Mentz | H04R 5/02 |
| 2017/0289495 | A1* | 10/2017 | Farrell | H04N 9/8211 |
| 2017/0289724 | A1* | 10/2017 | Breebaart | H04S 7/30 |

* cited by examiner

METHOD, EQUIPMENT AND APPARATUS FOR ACQUIRING SPATIAL AUDIO DIRECTION VECTOR

CROSS-REFERENCE TO RELATED APPLICATION

This application claims the benefit of Hong Kong Patent Application No. 16103566.0 filed on Mar. 29, 2016, the contents of which are hereby incorporated by reference.

BACKGROUND

Technical Field

The present invention relates to the field of sound signal processing technologies, and in particular, to a method, an equipment and an apparatus for acquiring a spatial audio direction vector.

Related Art

In the history of development of audio visual technologies, independent development of display technologies (such as multi-planar three dimensions, 360° VR and the like) from the multi-angle and multi-channel audio technologies has been a popular field. With popularity of surround sounds, for example, Dolby 5.1, 7.1 and the most advanced surround sound system 22.2 with 24 speakers, multi-planar three-dimensional display, VR, AR, and MR (mixed reality) are brand-new user experience. How to satisfy requirements of viewers for sound direction/depth information is an urgent problem to be solved.

SUMMARY

A major objective of the embodiments of the present invention is to provide a method, an equipment and an apparatus for acquiring a spatial audio direction vector, to improve the level of experience in sound for viewers.

In order to achieve the objective, there is provided a method of acquiring a spatial audio direction vector, including:

determining a position of a sound source in a multi-sound system;

setting a parameter, wherein the parameter comprises: a human response time $\Delta t$ and a tolerance percentage $\delta$;

acquiring a sound signal from the sound source; and processing the sound signal by using the parameter and acquiring a corresponding spatial audio direction vector $\vec{E}$ within each of the time interval $\Delta t$.

Preferably, the method further includes:

determining a vector angle $\theta_E$ of the spatial audio direction vector $\vec{E}$ according to the spatial audio direction vector $\vec{E}$.

Preferably, the method further includes:

determining a value range of a proportional constant D according to the vector angle $\theta_E$; and determining a value of the proportional constant D according to the value range of the proportional constant D.

Preferably, the spatial audio direction vector $\vec{E}$ is determined according to a quantity of elements in a set R of vectors, wherein an expression of the set R is: $R=\{\overline{u_j(\Delta t)}\}$, wherein $|u_{max}-(u_{max}-u_{min})\delta \le |\overline{u_j(\Delta t)}|^2 \le u_{max}$, $1 \le j \le J$, $u_{max}=\max\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$, and $u_{min}=\min\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$; $|\overline{u_j(\Delta t)}|^2$ is determined according to a sum of respective squares of amplitudes corresponding to all of sampling points of a signal waveform over a $j^{th}$ channel within a time interval $\Delta t$; J represents a total quantity of channels in the multi-sound system; and j represents an index value of a channel in the multi-sound system; and when there is only one element in the set R, $\vec{E}=\overline{u_j(\Delta t)}$; and when there are at least two elements in the set R, the vector $\vec{E}$ is determined by adding all vectors in the set R of vectors, wherein $\overline{u_j(\Delta t)}$ represents a corresponding signal vector over the $j^{th}$ channel within the time interval $\Delta t$.

Preferably, the value range of the proportional constant D is:

when $-90° \le \theta_E \le 90°$, $0 < D \le 1$; and when $-180° \le \theta_E < -90°$ or $90° < \theta_E \le 180°$, $-1 \le D < 0$.

Preferably, the value of the proportional constant D is:

when $0 < D \le 1$, the proportional constant D is determined according to a modulus of the vector $\vec{E}$ and a sum of respective squares of moduli of all vectors in the set R; and when $-1 \le D < 0$, the proportional constant D is determined by picking minus based on a modulus of the vector $\vec{E}$ and a sum of respective squares of moduli of all vectors in the set R.

Preferably, the method further includes:

when an actual audio frequency that is input to the multi-sound system does not satisfy a requirement for an audio frequency needed by the multi-sound system, processing the actual audio frequency that is input to the multi-sound system by using an aggregate function or a decomposition function, to transform the actual audio frequency that is input to the multi-sound system into one that satisfies the requirement for the audio frequency needed by the multi-sound system.

In order to achieve the objective, there is also provided an apparatus for acquiring a spatial audio direction vector, including:

a sound source determining unit, configured to determine a position of a sound source in a multi-sound system;

a parameter determining unit, configured to set a parameter, wherein the parameter comprises: a human response time $\Delta t$ and a tolerance percentage $\delta$;

a sound signal acquiring unit, configured to acquire a sound signal from the sound source; and a spatial audio direction vector acquiring unit, configured to process the sound signal by using the parameter and acquire a corresponding spatial audio direction vector $\vec{E}$ within each time of the interval $\Delta t$.

Preferably, the apparatus further includes:

a spatial audio direction vector angle acquiring unit, configured to determine a vector angle $\theta_E$ of the spatial audio direction vector $\vec{E}$ according to the spatial audio direction vector $\vec{E}$.

Preferably, the apparatus further includes:

a proportional constant value range unit, configured to determine a value range of a proportional constant D according to the vector angle $\theta_E$; and a proportional constant evaluation unit, configured to determine a value of the proportional constant D according to the value range of the proportional constant D.

Preferably, the spatial audio direction vector acquiring unit determines the spatial audio direction vector $\vec{E}$ according to a quantity of elements in a set R of vectors, wherein an expression of the set R is: $R=\{\overline{u_j(\Delta t)}\}$, wherein $|u_{max}-(u_{max}-u_{min})\delta \le |\overline{u_j(\Delta t)}|^2 \le u_{max}$, $1 \le j \le J$, $u_{max}=\max\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$, and $u_{min}=\min\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$; $|\overline{u_j(\Delta t)}|^2$ is determined according to a sum of respective squares of amplitudes corresponding to all of sampling points of a signal waveform over a $j^{th}$ channel within a time interval $\Delta t$; J represents a total quantity of channels in the multi-sound system; and j represents an index value of a channel in the multi-sound system; and when there is only one element in the set R, $\vec{E}=\overline{u_j(\Delta t)}$; and when there are at least two elements in the set R, $\vec{E}$ is determined by adding all vectors in the set R of vectors, wherein $\overline{u_j(\Delta t)}$ represents a corresponding signal vector over the $j^{th}$ channel within a time interval $\Delta t$.

Preferably, the value range of the proportional constant D determined by the proportional constant value range unit is:

when $-90° \le \theta_E \le 90°$, $0 < D \le 1$; and when $-180° \le \theta_E < -90°$ or $90° < \theta_E \le 180°$, $-1 \le D < 0$.

Preferably, the value of the proportional constant D determined by the proportional constant evaluation unit is:

when $0 < D \le 1$, the proportional constant D is determined according to a modulus of the vector $\vec{E}$ and a sum of respective squares of moduli of all vectors in the set R; and when $-1 \le D < 0$, the proportional constant D is determined by picking minus based on a modulus of the vector $\vec{E}$ and a sum of respective squares of moduli of all vectors in the set R.

Preferably, the apparatus further includes:

a preprocessing unit, configured to: when an actual audio frequency that is input to the multi-sound system does not satisfy a requirement for an audio frequency needed by the multi-sound system, process the actual audio frequency that is input to the multi-sound system by using an aggregate function or a decomposition function, to transform the actual audio frequency that is input to the multi-sound system into one that satisfies the requirement for the audio frequency needed by the multi-sound system.

In order to achieve the objective, there is also provided an equipment, including the above-mentioned apparatus for acquiring a spatial audio direction vector.

The aforementioned technical solution has the following advantageous effects:

By this technical solution, a spatial audio direction vector $\vec{E}$ is obtained, and spatial information of depth and direction is provided for a virtual image corresponding to a surround audio signal by using the vector $\vec{E}$, to match an audio signal and an image, thereby improving viewing experience of a viewer. In addition, a home multi-sound system may be adjusted according to the spatial audio direction vector $\vec{E}$, to optimize a relationship between a sound box and a user and to improve the level of experience of the user.

BRIEF DESCRIPTION OF THE DRAWINGS

To illustrate the technical solutions in the embodiments of the present invention or in the prior art more clearly, the accompanying drawings required for describing the embodiments or the prior art are briefly described below. It should be apparent that the accompanying drawings in the following descriptions merely show some of the embodiments of the present invention, and persons of ordinary skill in the art can derive other drawings from the accompanying drawings without creative efforts.

DETAILED DESCRIPTION

Figure 1:
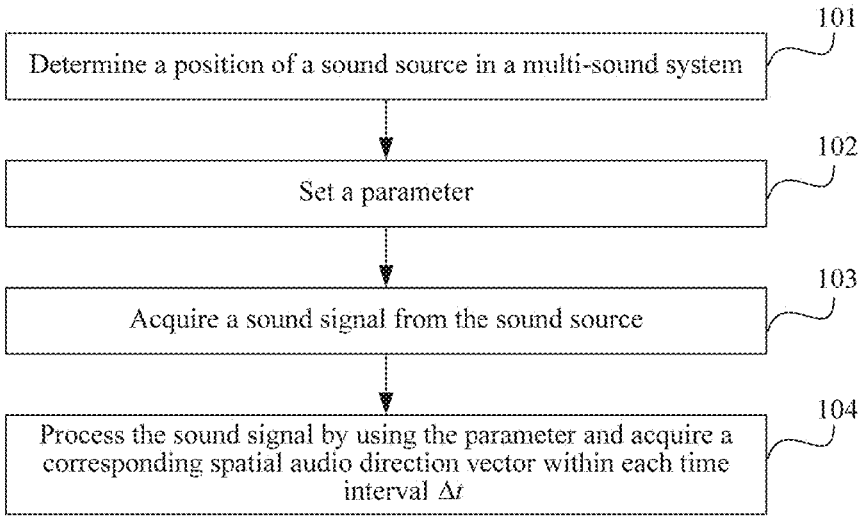
FIG. 1 is a first schematic flowchart of a method according to an embodiment of the present invention.

The technical solutions according to the embodiments of the present invention are clearly and fully described below with reference to the accompanying drawings in the embodiments of the present invention. It should be apparent that the embodiments in the following description are merely a part rather than all of the embodiments of the present invention. All other embodiments obtained by a person of ordinary skill in the art based on the embodiments of the present invention without creative efforts shall fall within the protection scope of the present invention.

It is known to a person of ordinary skill in the art that the present invention can be implemented as a system, an apparatus, equipment, a method, or a computer program product. Therefore, this disclosure may be specifically implemented in the following forms, that is, complete hardware, complete software (including firmware, resident software, micro code, and the like), or a combined form of hardware and software.

An implementing manner of the present invention provides a method, an apparatus, and a system for acquiring a spatial audio direction vector.

The following terms in the present description should be noted:

1. Multi-channel: Multiple sound tracks are used to recreate a sound in a multi-sound system. In the system, different types of speakers or sound boxes are configured according to a quantity of sound tracks, and two numerals are separated by using one decimal point to differentiate different sound systems, for example, 2.1 channel, 5.1 channel, 7.1 channel, 22.1 channel, and the like.

2. Vector: Includes vector magnitude and a vector angle, For example: in a vector $R=x+iy$, the vector magnitude is represented by $\sqrt{x^2+y^2}$ and the vector angle is represented by $$\theta = \tan^{-1}\frac{y}{x}.$$

In addition, a quantity of any elements in the accompanying drawings is used for illustrative purpose rather than limitation, and any name is used only for differentiating rather than providing any limitation meaning.

The principles and spirits of the present invention are illustrated in detail with reference to several representative implementing modes of the present invention.

Brief Description of the Invention

This technical solution relates to an equipment, a method and an apparatus, for transforming a multi-channel audio input signal into spatial information. The spatial information is referred to as a spatial audio direction vector below. A multi-sound audio signal may be a 5.1 surround sound signal, a 7.1 surround sound signal, or a 10.1 surround sound signal, and the like. The spatial audio direction vector is a main audio signal in a multi-channel signal within any given time. The main audio signal may be used to control depth of a 3D image or depth of a 3D video and be applied in the aspects of three-dimensional display, a fountain show, an advertisement, and interactive equipment, thereby bringing about a greatest influence on the sense of a viewer.

After describing the basic principles of the present invention, various non-limiting implementing manners of the present invention are described below.

Overview of Application Scenarios

In application in a three-dimensional, audio and video system, whether a 3D image is presented outward of a display screen or inward of the display screen is determined according to a proportional constant D of a spatial audio direction vector $\vec{E}$, and spatial information may be provided for depth and direction of a surround audio signal, to match an audio signal and a three-dimensional image, thereby improving viewing experience of a viewer.

For example, in a fountain theme park, a spatial audio direction vector $\vec{E}$ is acquired according to an audio of fountain music. The spatial audio direction vector $\vec{E}$ may provide an additional direction for fountain movement or interactive projected image. The additional direction is a direction of the spatial audio direction vector $\vec{E}$, and the direction is represented by using a vector angle $\theta_E$. Along with a change in the music, the spraying direction of the fountain varies in a range of 0° to 360°, thereby improving viewing experience of a viewer.

In virtual reality, for example, in an interactive game, a player is taken as a center point in the game to listen to music played by a multi-sound system. Front-left, front-middle, and front-right speakers are provided in front of the player, and rear-left, rear-right speakers are provided behind the player. A butterfly is taken as a target and is presented in the game according to a direction of a spatial audio direction vector $\vec{E}$. The player may accumulate a score by aiming at the target (the butterfly) with a head movement. In the application scenario, the direction of the spatial audio direction vector $\vec{E}$ is a vector angle $\theta_E$.

Exemplary Methods

The methods of the exemplary implementing manners of the present invention are described below respectively with reference to FIG. 1, FIG. 2, and FIG. 3 in combination with the application scenarios.

It should be noted that the foregoing application scenarios are provided only for understanding the spirit and principles of the present invention and the implementing manners of the present invention are not limited in this respect. On the contrary, the implementing manners of the present invention may be applicable to any suitable scenarios.

Referring to FIG. 1, FIG. 1 is a first schematic flowchart of a method according to an embodiment of the present invention. As shown in FIG. 1, the method of acquiring a spatial audio direction vector includes steps of:

Step 101): Determine a position of a sound source in a multi-sound system.

In this embodiment, when an actual audio frequency that is input to the multi-sound system does not satisfy a requirement for an audio frequency needed by the multi-sound system, the actual audio frequency that is input to the multi-sound system is processed by using an aggregate function or a decomposition function and is transformed into one that satisfies the requirement for the audio frequency needed by the multi-sound system.

Step 102): Set a parameter, where the parameter includes: a human response time $\Delta t$ and a tolerance percentage $\delta$.

Step 103): Acquire a sound signal from the sound source.

Step 104): Process the sound signal by using the parameter and acquire a corresponding spatial audio direction vector $\vec{E}$ within each time interval $\Delta t$.

In the technical solution, the acquired spatial audio direction vector $\vec{E}$ is a sound signal having a strongest sound energy over the channel.

In this embodiment, the corresponding spatial audio direction vector $\vec{E}$ within each time interval $\Delta t$ acquired in step 104 is determined according to a quantity of elements in a set R of vectors, where:

an expression of the set R is: $R=\{\overline{u_j(\Delta t)}\}$, where $|u_{max}-(u_{max}-u_{min})\delta \le |\overline{u_j(\Delta t)}|^2 \le u_{max}$, $1 \le j \le J$, $u_{max}=\max\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$, and $u_{min}=\min\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$; $|\overline{u_j(\Delta t)}|^2$ is determined according to a sum of respective squares of amplitudes corresponding to all of sampling points of a signal waveform over a $j^{th}$ channel within a time interval $\Delta t$; J represents a total quantity of channels in the multi-sound system; and j represents an index value of a channel in the multi-sound system; and when there is only one element in the set R, $\vec{E}=\overline{u_j(\Delta t)}$; and when there are at least two elements in the set R, $\vec{E}$ is determined by adding all vectors in the set R of vectors, where $\overline{u_j(\Delta t)}$ represents a corresponding signal vector over the $j^{th}$ channel within a time interval $\Delta t$.

For example, a frequency of a sound signal transmitted over a single channel is 44100 Hz, which means there are 44100 sampling points within is for the sound signal. Then, there are 11025 sampling points within 0.25 s. If setting $\Delta t=0.25$ s, $|\overline{u_j(\Delta t)}|^2$ is determined based on a sum of respective squares of amplitudes corresponding to the 11025 sampling points in a signal waveform within each 0.25 s. Then, a corresponding spatial audio direction vector $\vec{E}$ within each 0.25 s is determined by using the algorithm in step 104.

Figure 2:
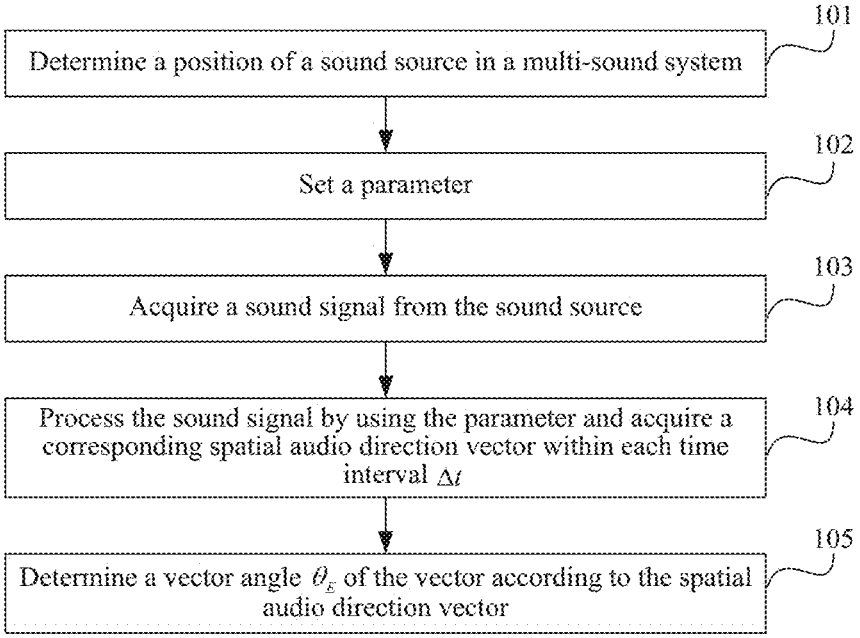
FIG. 2 is a second schematic flowchart of a method according to an embodiment of the present invention.

FIG. 2 is a second schematic flowchart of a method according to an embodiment of the present invention. On the basis of FIG. 1, the method further includes:

Step 105): Determine an angle $\theta_E$ of the spatial audio direction vector $\vec{E}$ according to the spatial audio direction vector $\vec{E}$.

In this step, the vector angle of the vector may be directly determined according to the spatial audio direction vector.

Figure 3:
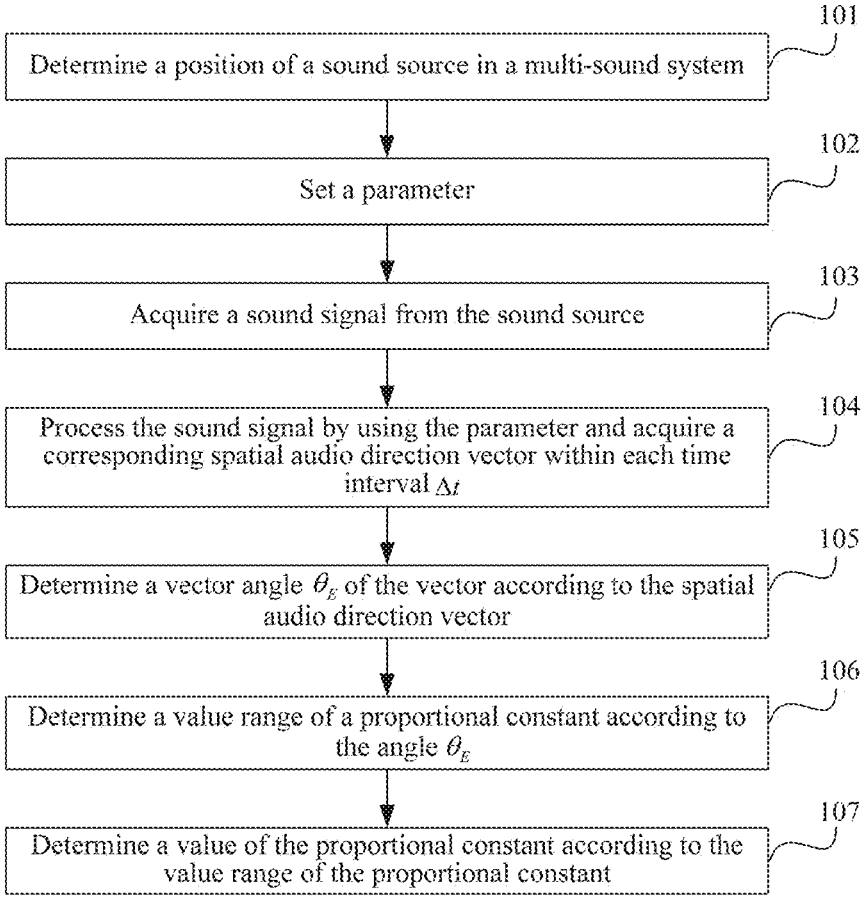
FIG. 3 is a third schematic flowchart of a method according to an embodiment of the present invention.

FIG. 3 is a third schematic flowchart of a method according to an embodiment of the present invention. On the basis of FIG. 2, the method further includes:

Step 106: Determine a value range of a proportional constant D according to the angle $\theta_E$.

Figure 4:
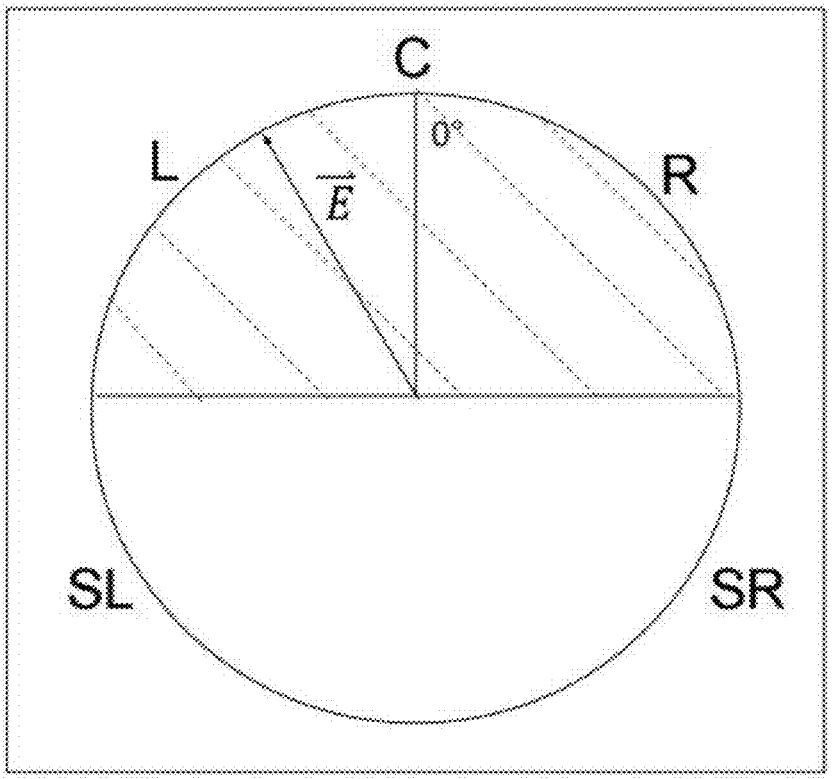
FIG. 4 is a schematic diagram of a spatial audio direction vector $\vec{E}$ when a proportional constant D is a positive value.
Figure 5:
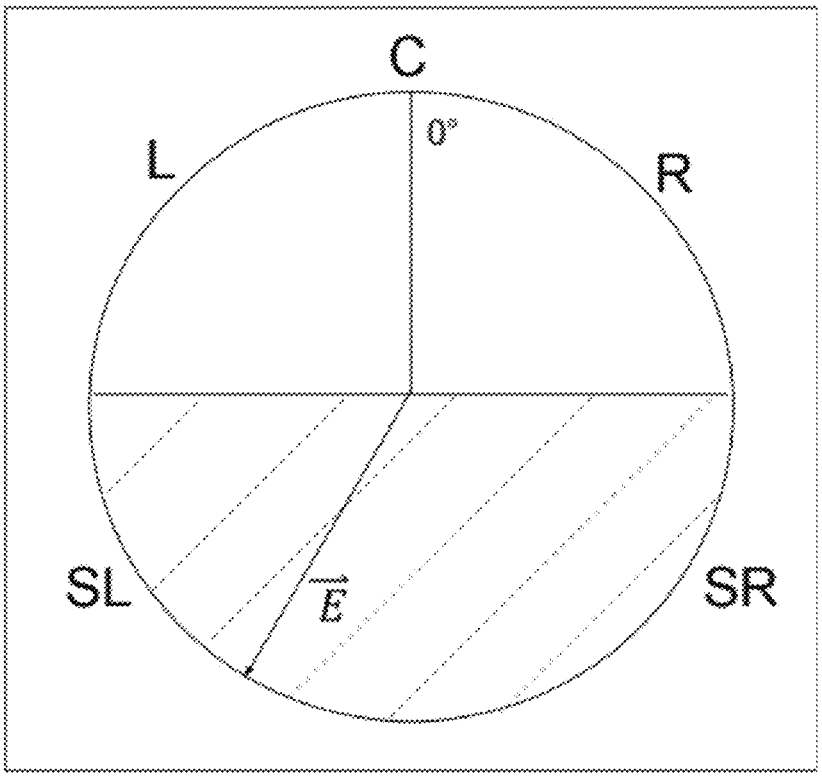
FIG. 5 is a schematic diagram of a spatial audio direction vector $\vec{E}$ when a proportional constant D is a negative value.

As shown in FIG. 4, FIG. 4 is a schematic diagram of the spatial audio direction vector $\vec{E}$ when the proportional constant D is a positive value. When $-90° \leq \theta_E \leq 90°$, $0 < D \leq 1$ As shown in FIG. 5, FIG. 5 is a schematic diagram of the spatial audio direction vector $\vec{E}$ when the proportional constant D is a negative value. When $-180° \leq \theta_E < -90°$ or $90° < \theta_E \leq 180°$, $1 \leq D < 0$.

Step 107): Determine a value of the proportional constant D according to the value range of the proportional constant D.

When $0 < D \leq 1$, $$D = \frac{|\vec{E}|}{\sum_j |\overrightarrow{u_j(\Delta t)}|^2 \text{ in set } R}.$$

When $-1 \leq D < 0$, $$D = -\frac{|\vec{E}|}{\sum_j |\overrightarrow{u_j(\Delta t)}|^2 \text{ in set } R}.$$

$|\vec{E}|$ represents a modulus of the vector $\vec{E}$.

$$\sum_j |\overrightarrow{u_j(\Delta t)}|^2 \text{ in set } R$$

represents a sum of respective squares of moduli of all vectors in the set R.

When $-1 \leq D < 0$, a virtual image is presented inward of a display screen. A total quantity of subdivisions of the distance h from the virtual image to the display screen is $$\left\lfloor \frac{h}{\Delta z} \right\rfloor.$$

$\Delta z$ is determined according to z. A quantity of target discrete intervals is $$\left\lfloor \frac{h \times D}{\Delta z} \right\rfloor.$$

When $0 < D \leq 1$, a virtual image is presented outward of a display screen. A total quantity of subdivisions of the distance H from the virtual image to the display screen is $$\left\lfloor \frac{H}{\Delta z} \right\rfloor.$$

A quantity of target discrete intervals is $$\left\lfloor \frac{H \times D}{\Delta z} \right\rfloor.$$

In this embodiment, H represents a maximum value of the distance from the virtual image to the outward of the display screen and h represents a maximum value of the distance from the virtual image to the inward of the display screen. Discrete processing is performed on H and h. The virtual image is presented at a $$\left\lfloor \frac{H \times D}{\Delta z} \right\rfloor th$$

$\Delta z$ position in a corresponding direction by using the display screen as a start point. For example, if the proportional constant D is determined to be 1, $\Delta z$ is 2, and H is 8, $$\left\lfloor \frac{H \times D}{\Delta z} \right\rfloor$$

is determined to be 4 which represents that the virtual image may be presented at a fourth $\Delta z$ position outward of the display screen. If the proportional constant D is determined to be −0.5, $\Delta z$ is 2, and h is 6, $$\left\lfloor \frac{h \times D}{\Delta z} \right\rfloor$$

is determined to be 1 which represents that the virtual image may be presented at a first $\Delta z$ position inward of the display screen.

It should be noted that although the operations of the method of the present invention are described in a specific sequence in the accompanying drawings, it does not require or imply that these operations need to be executed according to the specific sequence. It also does not require or imply that a desired result can be achieved only by executing all shown operations. Additionally or optionally, some steps may be omitted, several steps may be combined into one step for execution, and/or one step may be decomposed into several steps for execution.

Exemplary Apparatuses

After describing the method of the exemplary implementing manners of the present invention, subsequently, apparatuses of the exemplary implementing manners of the present invention are described below with reference to FIG. 6, FIG. 7, FIG. 8, and FIG. 9.

Figure 6:
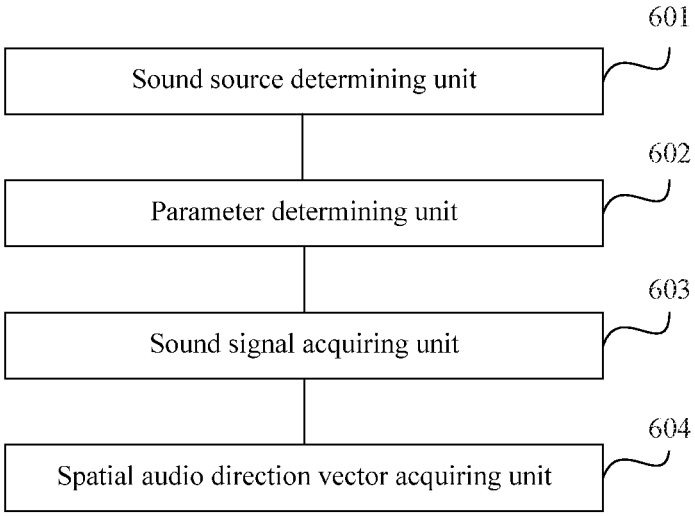
FIG. 6 is a first block diagram of an apparatus according to an embodiment of the present invention.

As shown in FIG. 6, FIG. 6 is a first block diagram of an apparatus according to an embodiment of the present invention. The apparatus for acquiring a spatial audio direction vector includes: a sound source determining unit 601, a parameter determining unit 602, a sound signal acquiring unit 603, and a spatial audio direction vector acquiring unit 604.

The sound source determining unit 601 is configured to determine a position of a sound source in a multi-sound system.

In this embodiment, when an actual audio frequency that is input to the multi-sound system does not satisfy a requirement for an audio frequency needed by the multi-sound system, the sound source determining unit 601 is further configured to process the actual audio frequency that is input to the multi-sound system by using an aggregate function or a decomposition function and transform the same into one that satisfies the requirement for the audio frequency needed by the multi-sound system.

The parameter determining unit 602 is configured to set a parameter, where the parameter includes: a human response time $\Delta t$ and a tolerance percentage $\delta$;

The sound signal acquiring unit 603 is configured to acquire a sound signal from the sound source.

The spatial audio direction vector acquiring unit 604 is configured to process the sound signal by using the parameter and acquire a corresponding spatial audio direction vector $\vec{E}$ within each time interval $\Delta t$.

In this embodiment, the corresponding spatial audio direction vector $\vec{E}$ within each time interval $\Delta t$ acquired by spatial audio direction vector acquiring unit 604 is determined according to a quantity of elements in a set R of vectors, where:

an expression of the set R is: $R=\{\overline{u_j(\Delta t)}\}$, where $|u_{max}-(u_{max}-u_{min})\delta \le |\overline{u_j(\Delta t)}|^2 \le u_{max}$, $1 \le j \le J$, $u_{max}=\max\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$, and $u_{min}=\min\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$; $|\overline{u_j(\Delta t)}|^2$ is determined according to a sum of respective squares of amplitudes corresponding to all of sampling points of a signal waveform over a $j^{th}$ channel within a time interval $\Delta t$; J represents a total quantity of channels in the multi-sound system; and j represents an index value of a channel in the multi-sound system; and when there is only one element in the set R, $\vec{E}=\overline{u_j(\Delta t)}$: and when there are at least two elements in the set R, $\vec{E}$ is determined by adding all vectors in the set R of vectors, where $\overline{u_j(\Delta t)}$ represents a corresponding signal vector over the $j^{th}$ channel within a time interval $\Delta t$.

Figure 7:
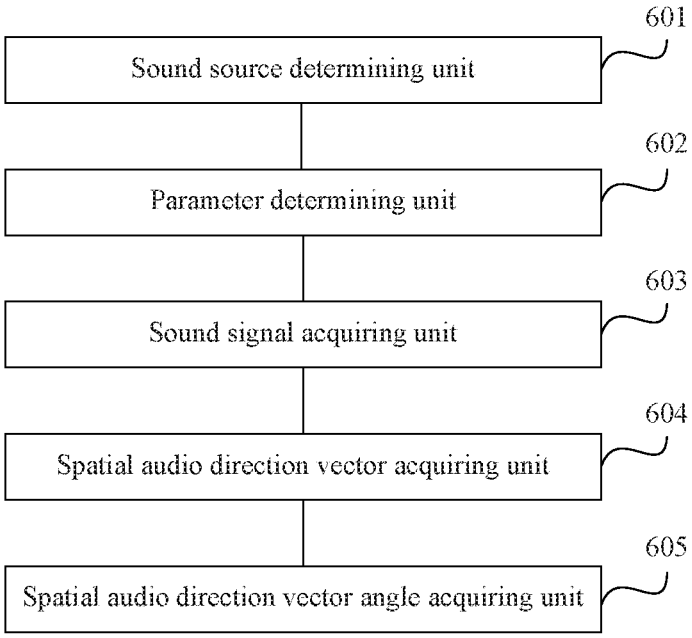
FIG. 7 is a second block diagram of an apparatus according to an embodiment of the present invention.

After the spatial audio direction vector $\vec{E}$ is acquired, the spatial audio direction vector $\vec{E}$ is processed to acquire an angle $\theta_E$ and a proportional constant D. Then, as shown in FIG. 7, FIG. 7 is a second block diagram of an apparatus according to an embodiment of the present invention. On the basis of FIG. 6, the apparatus further includes:

a spatial audio direction vector angle acquiring unit 605, configured to determine an angle $\vec{E}$ of the spatial audio direction vector $\vec{E}$ according to the spatial audio direction vector $\theta_E$.

In this embodiment, the spatial audio direction vector angle acquiring unit 605 may directly determine the vector angle of the vector according to the spatial audio direction vector.

Figure 8:
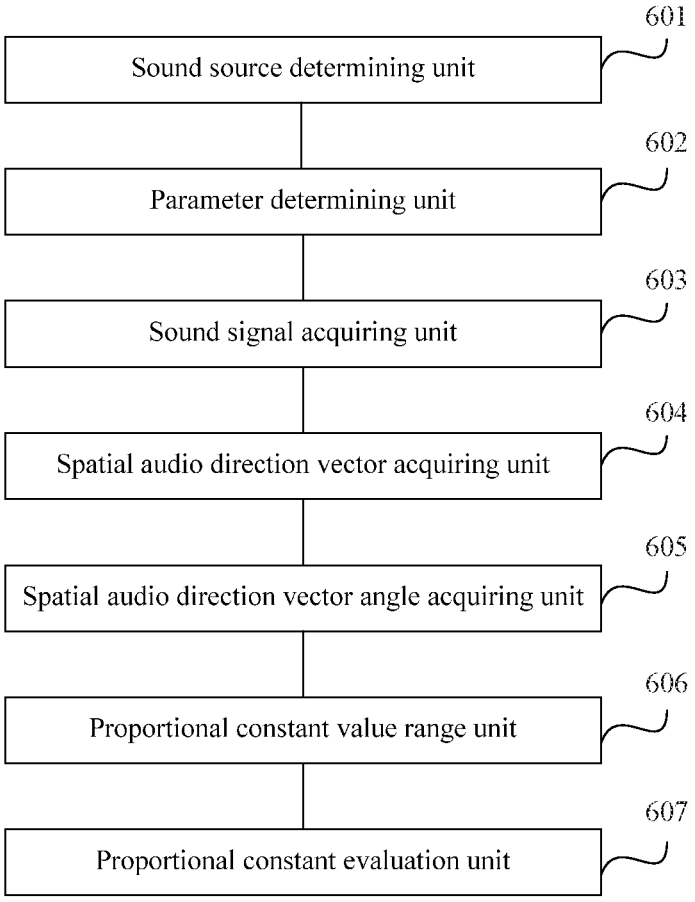
FIG. 8 is a third block diagram of an apparatus according to an embodiment of the present invention.

As shown in FIG. 8, FIG. 8 is a third block diagram of an apparatus according to an embodiment of the present invention, On the basis of FIG. 7, the apparatus further includes:

a proportional constant value range unit 606, configured to determine a value range of a proportional constant D according to the angle $\theta_E$; and a proportional constant evaluation unit 607, configured to determine a. value of the proportional constant D according to the value range of the proportional constant D.

In this embodiment, when $-90° \le \theta_E \le 90°$, the proportional constant value range unit 606 determines that the value range of the proportional constant D is $0<D\le 1$, and the proportional constant evaluation unit 607 determines a value of the proportional constant by using an expression $$D = \frac{|\vec{E}|}{\sum_j |\overline{u_j(\Delta t)}|^2 \text{ in set } R}.$$

When $-180° \le \theta_E < -90°$ or $90° < \theta_E \le 180°$, the proportional constant value range unit 606 determines that the value range of the proportional constant D is $-1 \le D < 0$, the proportional constant evaluation unit 607 determines a value of the proportional constant by using the expression $$D = -\frac{|\vec{E}|}{\sum_j |\overline{u_j(\Delta t)}|^2 \text{ in set } R}.$$

On the foregoing basis, when $-1 \le D < 0$, a virtual image is presented inward of a display screen. A total quantity of subdivisions of the distance h from the virtual image to the display screen is $$\left\lfloor \frac{h}{\Delta z} \right\rfloor.$$

Where $\Delta z$ is determined according to z. A quantity of target discrete intervals is $$\left\lfloor \frac{h \times D}{\Delta z} \right\rfloor.$$

When $0<D\le 1$, a virtual image is presented outward of a display screen. A total quantity of subdivisions of the distance H from the virtual image to the display screen is $$\left\lfloor \frac{H}{\Delta z} \right\rfloor.$$

A quantity of target discrete intervals is $$\left\lfloor \frac{H \times D}{\Delta z} \right\rfloor.$$

In this embodiment, H represents a maximum value of the distance from the virtual image to the outward of the display screen and h represents a maximum value of the distance from the virtual image to the inward of the display screen. Discrete processing is performed on H and h. The virtual image is presented at a $$\left\lfloor \frac{H \times D}{\Delta z} \right\rfloor th$$

$\Delta z$ position in a corresponding direction by using the display screen as a start point. For example, if the proportional constant D is determined to be 1, $\Delta z$ is 2, and H is 8, $$\left\lfloor \frac{H \times D}{\Delta z} \right\rfloor$$

is determined to be 4 which represents that the virtual image may be presented at a fourth Δz position outward of the display screen. If the proportional constant D is determined to be −0.5, Δz is 2, and h is 6, $$\left\lfloor \frac{h \times D}{\Delta z} \right\rfloor$$

is determined to be 1 which represents that the virtual image may be presented at a first Δz position inward of the display screen.

In addition, despite several units of the apparatus are mentioned in the foregoing detailed description, such a division is not compulsory. In practice, the foregoing described features and functions of two or more units may be specifically implemented in one unit according to the implementing manners of the present invention. Similarly, the foregoing described features and functions of one unit may also be further divided and specifically implemented in a plurality of units.

Exemplary Equipment

Figure 9:
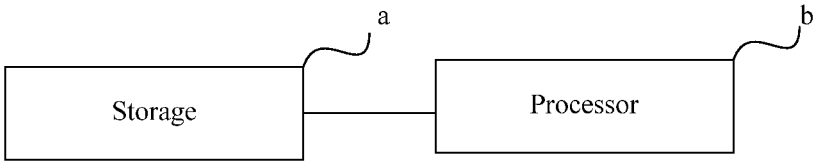
FIG. 9 is a block diagram of equipment according to an embodiment of the present invention.

On the basis of the exemplary apparatuses and methods, this embodiment further provides equipment, as shown in FIG. 9. The system is configured to acquire a spatial audio direction vector and includes:

a storage a, configured to store a request instruction; and a processor b, coupled to the storage and configured to execute a request instruction stored in the storage, where the processor is configured by an application to be used for:

determining a position of a sound source in a multi-sound system;

setting a parameter, where the parameter includes: a human response time Δt and a tolerance percentage δ;

acquiring a sound signal from the sound source;

processing the sound signal by using the parameter and acquiring a corresponding spatial audio direction vector $\vec{E}$ within each time interval Δt.

The spatial audio direction vector $\vec{E}$ is further processed, and the processor is configured by the application to be further used for:

determining an angle $\theta_E$ of the spatial audio direction vector $\vec{E}$ according to the spatial audio direction vector $\vec{E}$;

determining a value range of a proportional constant D according to the angle $\theta_E$; and determining a value of the proportional constant D according to the value range of the proportional constant D.

The embodiments of the present invention further provide a computer readable program. When the program is executed in electronic equipment, the program enables the computer to execute the methods for acquiring a spatial audio direction vector, as shown in FIG. 1, FIG. 2, and FIG. 3, in the electronic equipment.

The embodiments of the present invention further provide a storage medium that stores a computer readable program, where the computer readable program may enable the computer to execute the methods for acquiring a spatial audio direction vector, as shown in FIG. 1, FIG. 2, and FIG. 3, in the electronic equipment.

Embodiments

To more readily describe the features and working principles of the present invention, the present invention is described below in combination with an actual application scenario.

Figure 10:
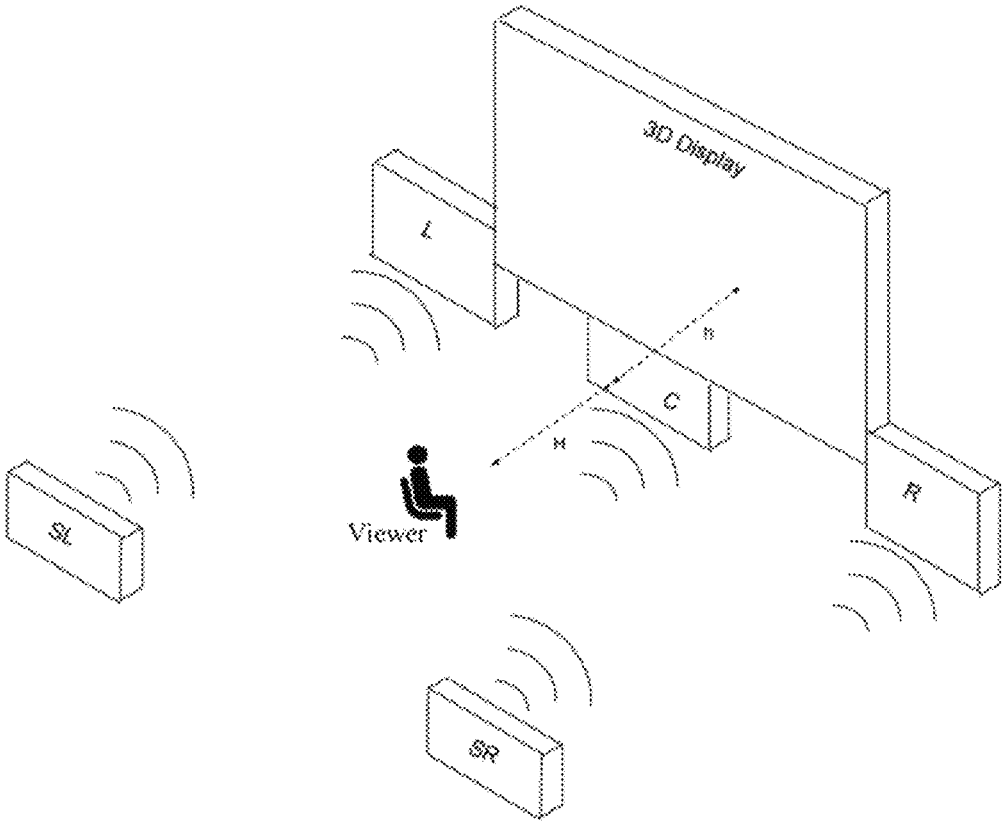
FIG. 10 is a schematic diagram of a 3D audio and video system in naked eyes according to this embodiment.

As shown in FIG. 10, FIG. 10 is a schematic diagram of a 3D audio and video system in naked eyes according to this embodiment. The application relates to the SADeV™ experiment and the purpose thereof is: to improve the level of experience of a viewer by using a spatial audio direction vector $\vec{E}$ in a 3D audio and video system in naked eyes.

In this embodiment, a 5.1 channel is used as an example. The 5.1 channel indicates a central channel, a front-left channel, a front-right channel, a rear-left surround channel, a rear-right surround channel, and an so-called 0.1 channel mega bass channel. A set of system may be connected to six speakers in total. The 5.1 channel has been widely used in various conventional cinemas and home cinemas. Some relatively well-known sound recording compression formats, such as Dolby AC-3 (Dolby Digital), DTS and the like, are all technically based on the 5.1 sound system. The "0.1" channel is a specially-designed super bass channel, and the channel may generate a super bass in a frequency range of 20 to 120 Hz, The 5.1 channel implements an immersive music playing mode by using five speakers and one super bass speaker. The 5.1 channel is developed by the Dolby Company and therefore is called "Dolby 5.1 channel". In the 5.1 channel system, sounds are output in five directions, namely, left (L), central (C), right (R), rear-left (SL), and rear-right (SR), to enable an individual to have a feeling of being in a concert hall. The five channels are independent from each other, where "0.1" channel is a specially-designed super bass channel. A sense of reality of being surrounded by music may be generated because there are speakers on all sides.

Assumption:

1. There are five speakers in the same model, where the speakers are configured in front, in central, or all around.

2. A listener is at an identical distance from the five speakers.

3. 3. An angle is adjusted according to a sight direction of a viewer: a central (C) angle is 0°, a left (L) angle is $-\theta_F$, a right (R) angle is $\theta_F$, a rear-left (SL) angle is $-\theta_S$, and a rear-right (SR) angle is $\theta_S$.

Figure 11:
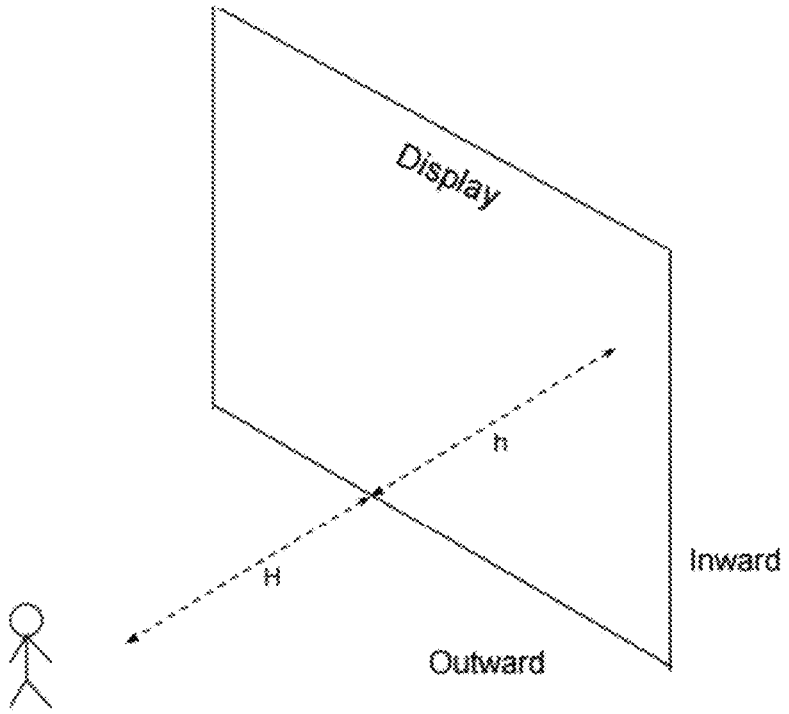
FIG. 11 is a first schematic diagram of analysis according to this embodiment.

As shown in FIG. 11, FIG. 11 is a first schematic diagram of analysis according to this embodiment. In FIG. 11, a screen is used as a reference, "outward" represents that a 3D image is presented in a direction in front of the screen, and "inward" represents that a 3D image is presents in a direction behind the screen. The value of the proportional constant D influences whether the virtual image is displayed outward or inward of the display screen. H represents a maximum value of the distance from the virtual image to the outward of the display screen and h represents a maximum value of the distance from the virtual image to the inward of the display screen. The parameters H and h are both set manually.

Figure 12:
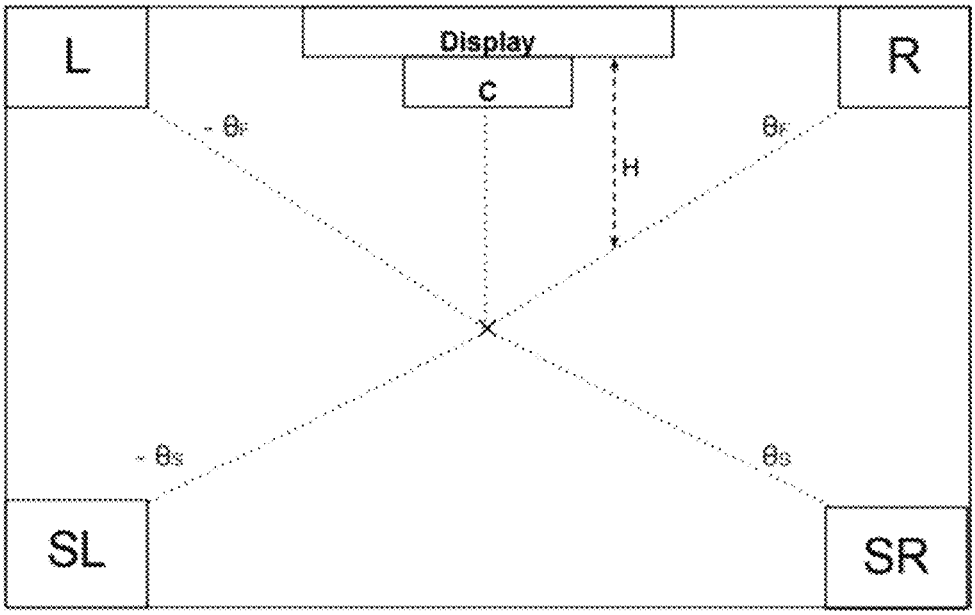
FIG. 12 is a second schematic diagram of analysis according to this embodiment.

As shown in FIG. 12, FIG. 12 is a second schematic diagram of analysis according to this embodiment. By means of the methods and apparatuses of this embodiment, the following parameters are set:

δ: Tolerance percentage, where a value δ>0; and in this embodiment, δ=0:2.

Δt: Time interval, where in this embodiment, Δt=2 s.

$\theta_F$: Position of front-left/front-right channel (in degree), where in this embodiment, an absolute value of $\theta_F$ is 30°:

$\theta_S$: Position of surround-left/surround-right channel (in degree), where in this embodiment, an absolute value of $\theta_S$ is 120°.

Figure 13:
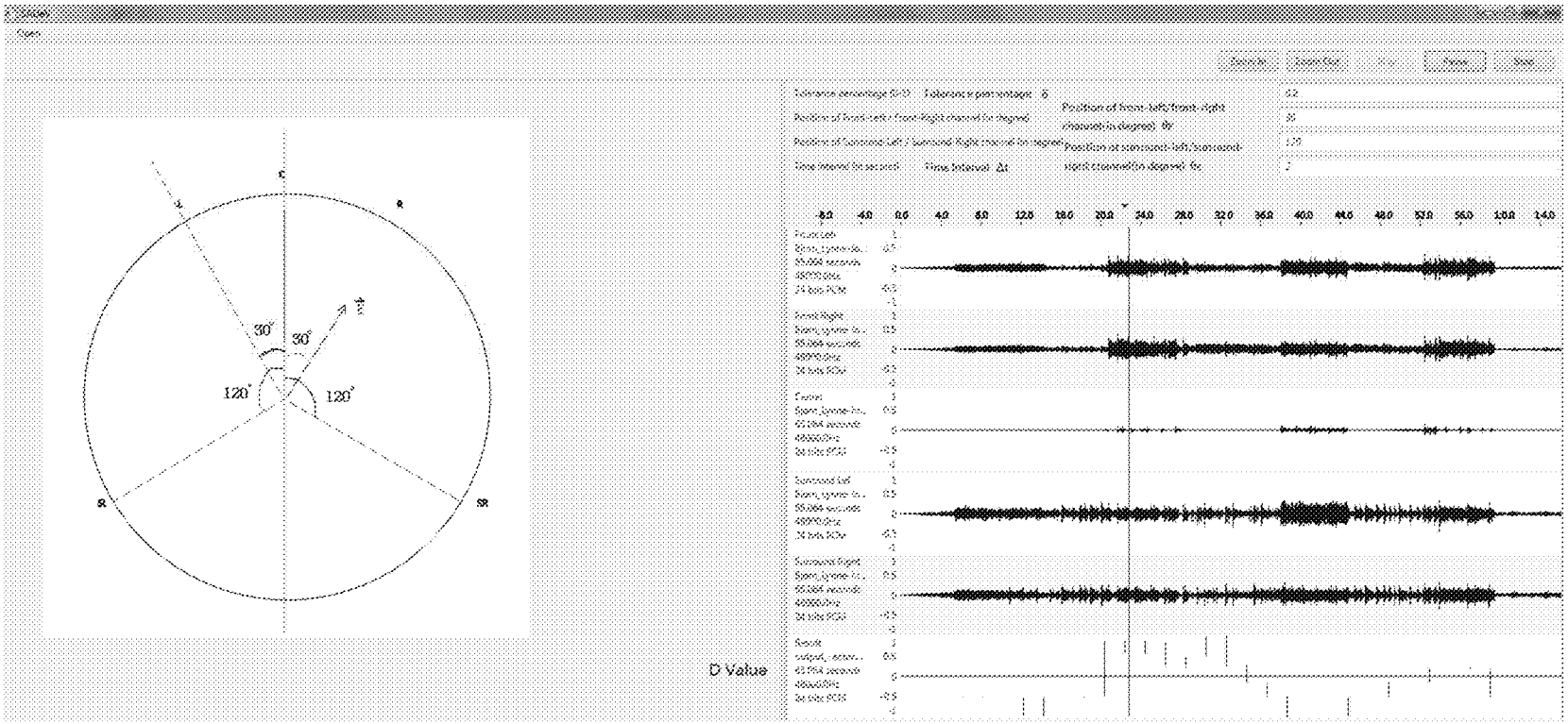
FIG. 13 is a schematic diagram of parameter settings according to this embodiment.

A lower portion of FIG. 13 shows waveforms of sound signals transmitted over the five channels. The first waveform diagram is a waveform diagram of a signal over the front-left channel, the second waveform diagram is a waveform diagram of a signal over the front-right channel, the third waveform diagram is a waveform diagram of a signal over the central channel, the fourth waveform diagram is a waveform diagram of a signal over the rear-left channel, and the fifth waveform channel is a waveform diagram of a signal over the rear-right channel. Through the processing in this technical solution, values of the proportional constant D in different time intervals are acquired, which is shown in the sixth diagram at the lower portion of FIG. 13.

A piece of audio is recorded under default settings of a multi-sound system. The default settings mean: the specific positions the sound boxes are placed during recording of the audio. A proportional constant D1 of the default settings is acquired by using this technical solution. When a user plays the piece of audio by using a home 5.1 multi-sound system, positions of the sound boxes set by the user are not necessarily the positions of the default settings. To improve the level of experience of a viewer, the user may customize the positions of the sound boxes to play the piece of audio, and a proportional constant D2 is then acquired by using this technical solution. Subsequently, the proportional constant D1 and the proportional constant D2 are compared. If there is not a great difference, it indicates that the customized setting of the user is relatively close to the settings before delivery. On the contrary, if there is a certain difference between the proportional constants, the user needs to continue to adjust the positions of the sound boxes, to make the positions close to that of the default settings. Therefore, a relationship between positions of the sound boxes and the user is optimized, thereby improving an overall level of experience of the user.

The objectives, technical solutions, and advantageous effects of the present invention are further described in detail in the foregoing specific embodiments. It should be understood that the foregoing embodiments are only specific embodiments of the present invention rather than intending to limit the protection scope of the present invention. Any modification, equivalent replacement, or improvement made without departing from the spirit and principles of the present invention shall fall within the protection scope of the present invention.

What is claimed is:

1. A method of acquiring a spatial audio direction vector, comprising:

determining a position of a sound source in a multi-sound system;

setting a parameter, wherein the parameter comprises: a human response time Δt and a tolerance percentage δ;

acquiring a sound signal from the sound source; and processing the sound signal by using the parameter and acquiring a corresponding spatial audio direction vector $\vec{E}$ within each of the time interval Δt.

2. The method according to claim 1, further comprising:

determining a vector angle $\theta_E$ of the spatial audio direction vector $\vec{E}$ according to the spatial audio direction vector $\vec{E}$.

3. The method according to claim 2, further comprising:

determining a value range of a proportional constant D according to the vector angle $\theta_E$; and determining a value of the proportional constant D according to the value range of the proportional constant D.

4. The method according to claim 1, wherein the spatial audio direction vector $\vec{E}$ is determined according to a quantity of elements in a set R of vectors, wherein an expression of the set R is: $R=\{\overline{u_j(\Delta t)}\}$, wherein $|u_{max}-(u_{max}-u_{min})\delta \le |\overline{u_j(\Delta t)}|^2 \le u_{max}$, $1 \le j \le J$, $u_{max}=\max\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$, and $u_{min}=\min\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$; $|\overline{u_j(\Delta t)}|^2$ is determined according to a sum of respective squares of amplitudes corresponding to all of sampling points of a signal waveform over a $j^{th}$ channel within a time interval Δt; J represents a total quantity of channels in the multi-sound system; and j represents an index value of a channel in the multi-sound system; and when there is only one element in the set R, $\vec{E}=\overline{u_j(\Delta t)}$; and when there are at least two elements in the set R, the vector $\vec{E}$ is determined by adding all vectors in the set R of vectors, wherein $\overline{u_j(\Delta t)}$ represents a corresponding signal vector over the $j^{th}$ channel within the time interval Δt.

5. The method according to claim 3, wherein the value range of the proportional constant D is:

when $-90° \le \theta_E \le 90°$, $0 < D \le 1$; and when $-180° \le \theta_E < -90°$ or $90° < \theta_E \le 180°$, $-1 \le D < 0$.

6. The method according to claim 5, wherein the value of the proportional constant D is:

when $0 < D \le 1$, the proportional constant D is determined according to a modulus of the vector $\vec{E}$ and a sum of respective squares of moduli of all vectors in the set R; and when $-1 \le D < 0$, the proportional constant D is determined by picking minus based on a modulus of the vector $\vec{E}$ and a sum of respective squares of moduli of all vectors in the set R.

7. The method according to claim 1, further comprising:

when an actual audio frequency that is input to the multi-sound system does not satisfy a requirement for an audio frequency needed by the multi-sound system, processing the actual audio frequency that is input to the multi-sound system by using an aggregate function or a decomposition function, to transform the actual audio frequency that is input to the multi-sound system into one that satisfies the requirement for the audio frequency needed by the multi-sound system.

8. An apparatus for acquiring a spatial audio direction vector, comprising:

a sound source determining unit, configured to determine a position of a sound source in a multi-sound system;

a parameter determining unit, configured to set a parameter, wherein the parameter comprises: a human response time Δt and a tolerance percentage δ;

a sound signal acquiring unit, configured to acquire a sound signal from the sound source: and a spatial audio direction vector acquiring unit, configured to process the sound signal by using the parameter and acquire a corresponding spatial audio direction vector $\vec{E}$ within each time of the interval $\Delta t$.

9. The apparatus according to claim 8, further comprising:

a spatial audio direction vector angle acquiring unit, configured to determine a vector angle $\theta_E$ of the spatial audio direction vector $\vec{E}$ according to the spatial audio direction vector $\vec{E}$.

10. The apparatus according to claim 9, further comprising:

a proportional constant value range unit, configured to determine a value range of a proportional constant D according to the vector angle $\theta_E$; and a proportional constant evaluation unit, configured to determine a value of the proportional constant D according to the value range of the proportional constant D.

11. The apparatus according to claim 8, wherein the spatial audio direction vector acquiring unit determines the spatial audio direction vector $\vec{E}$ according to a quantity of elements in a set R of vectors, wherein an expression of the set R is: $R=\{\overline{u_j(\Delta t)}\}$, wherein $|u_{max}-(u_{max}-u_{min})\delta \le |\overline{u_j(\Delta t)}|^2 \le u_{max}$, $1 \le j \le J$, $u_{max}=\max\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$, and $u_{min}=\min\{|\overline{u_1(\Delta t)}|^2, |\overline{u_2(\Delta t)}|^2, \ldots, |\overline{u_j(\Delta t)}|^2, \ldots, |\overline{u_J(\Delta t)}|^2\}$; $|\overline{u_j(\Delta t)}|^2$ is determined according to a sum of respective squares of amplitudes corresponding to all of sampling points of a signal waveform over a $j^{th}$ channel within a time interval $\Delta t$ ; J represents a total quantity of channels in the multi-sound system; and j represents an index value of a channel in the multi-sound system; and when there is only one element in the set R, $\vec{E}=\overline{u_j(\Delta t)}$; and when there are at least two elements in the set R, $\vec{E}$ is determined by adding all vectors in the set R of vectors, wherein $\overline{u_j(\Delta t)}$ represents a corresponding signal vector over the $j^{th}$ channel within a time interval $\Delta t$.

12. The apparatus according to claim 10, wherein the value range of the proportional constant D determined by the proportional constant value range unit is:

when $-90° \le \theta_E \le 90°$, $0 < D \le 1$; and when $-180° \le \theta_E < -90°$ or $90° < \theta_E \le 180°$, $-1 \le D < 0$.

13. The apparatus according to claim 12, wherein the value of the proportional constant D determined by the proportional constant evaluation unit is:

when $0 < D \le 1$, the proportional constant D is determined according to a modulus of the vector $\vec{E}$ and a sum of respective squares of moduli of all vectors in the set R; and when $-1 \le D < 0$, the proportional constant D is determined by picking minus based on a modulus of the vector $\vec{E}$ and a sum of respective squares of moduli of all vectors in the set R.

14. The apparatus according to claim 8, further comprising:

a preprocessing unit, configured to: when an actual audio frequency that is input to the multi-sound system does not satisfy a requirement for an audio frequency needed by the multi-sound system, process the actual audio frequency that is input to the multi-sound system by using an aggregate function or a decomposition function, to transform the actual audio frequency that is input to the multi-sound system into one that satisfies the requirement for the audio frequency needed by the multi-sound system.

15. An equipment, wherein the equipment comprises the apparatus for acquiring a spatial audio direction vector according to claim 8.

* * * * *